US009080343B2

(12) United States Patent
Jones

(10) Patent No.: US 9,080,343 B2
(45) Date of Patent: Jul. 14, 2015

(54) LEAF SKIMMING APPARATUS

(71) Applicant: J. Alan Jones, Tyler, TX (US)

(72) Inventor: J. Alan Jones, Tyler, TX (US)

( * ) Notice: Subject to any disclaimer, the term of this patent is extended or adjusted under 35 U.S.C. 154(b) by 186 days.

(21) Appl. No.: 13/790,370

(22) Filed: Mar. 8, 2013

(65) Prior Publication Data

US 2013/0233784 A1 Sep. 12, 2013

Related U.S. Application Data

(60) Provisional application No. 61/609,012, filed on Mar. 9, 2012.

(51) Int. Cl.
*E04H 4/16* (2006.01)

(52) U.S. Cl.
CPC ..... *E04H 4/1609* (2013.01)

(58) Field of Classification Search
CPC ..... E04H 4/1609
USPC ..... 210/167.1
See application file for complete search history.

(56) References Cited

U.S. PATENT DOCUMENTS

| | | | | | |
|---|---|---|---|---|---|
| 3,139,299 | A * | 6/1964 | Bowen | 294/1.4 |
| 3,733,098 | A * | 5/1973 | Tobias | 294/1.4 |
| 3,841,686 | A * | 10/1974 | Gallo et al. | 294/1.4 |
| 4,210,351 | A * | 7/1980 | Orofino | 294/1.5 |
| 4,225,174 | A * | 9/1980 | Hennessy et al. | 294/1.4 |
| 5,380,054 | A * | 1/1995 | Galvis | 294/1.4 |
| 7,992,907 | B1 * | 8/2011 | DeJesus | 294/1.4 |
| 2008/0303296 | A1 * | 12/2008 | Waltz | 294/1.4 |

* cited by examiner

*Primary Examiner* — Fred Prince
(74) *Attorney, Agent, or Firm* — Dale J. Ream

(57) ABSTRACT

A leaf skimming apparatus includes an elongate pole having first and second ends and defining a tubular configuration. A handle is positioned adjacent the pole first end. A scoop assembly is coupled to the housing second end, the scoop assembly having lower and upper scoop portions pivotally movable between open and closed configurations. A manually operable trigger is attached to the housing adjacent to the handle, the trigger being operatively connected to the scoop assembly and configured to selectively move the lower and upper scoop portions between the open and closed configurations. A linkage is situated in the housing that is operatively connected to the trigger and to the scoop assembly and configured to move the lower and upper scoop portions between the open and closed configurations upon respective operations of the trigger.

14 Claims, 9 Drawing Sheets

LEAF SKIMMING APPARATUS

CROSS REFERENCE TO RELATED APPLICATION

This non-provisional patent application claims the benefit of provisional application Ser. No. 61/609,012 filed on Mar. 9, 2012, titled Leaf Skimming Apparatus.

BACKGROUND OF THE INVENTION

This invention relates generally to swimming pool cleaning tools and, more particularly, to a leaf skimming apparatus that is configured to enable a user to lift a swimming pool skimmer basket or its lid without having to bend over.

Both residential and commercial swimming pools require a certain amount of regular cleaning to maintain a safe and desirable environment for swimming. The pools themselves may include skimmer baskets positioned at regular intervals around a pool that collect debris such as leaves, trash, and other debris. These skimmer baskets must be manually cleaned out on a regular basis in order to work efficiently and effectively.

Cleaning out skimmer baskets can be a inconvenient and labor intensive task in that a user must bend over at the waist to remove a skimmer basket from its position at or below water level or at least remove the basket's lid so as to access the basket's interior. For larger pools, there may be many baskets to clean such that a user must bend over, clean the basket, and return the basket to its operational position multiple times which may result in injury, fatigue, or frustration.

Therefore, it would be desirable to have a leaf skimming apparatus having an elongate pole that enables a user to reach a skimmer basket without having to bend at the waist. Further, it would be desirable to have a leaf skimming apparatus having a scoop assembly at a distal end of the pole and a trigger at a proximal end of the pole such that the scoop assembly may be opened and closed by action of the trigger in order to capture debris from inside the skimmer basket.

SUMMARY OF THE INVENTION

A leaf skimming apparatus according to the present invention includes an elongate pole having first and second ends and defining a tubular configuration. A handle is positioned adjacent the pole first end. A scoop assembly is coupled to the housing second end, the scoop assembly having lower and upper scoop portions pivotally movable between open and closed configurations. A manually operable trigger is attached to the housing adjacent to the handle, the trigger being operatively connected to the scoop assembly and configured to selectively move the lower and upper scoop portions between the open and closed configurations. A linkage is situated in the housing that is operatively connected to the trigger and to the scoop assembly and configured to move the lower and upper scoop portions between the open and closed configurations upon respective operations of the trigger.

Therefore, a general object of this invention is to provide a leaf skimming apparatus configured to enable a user to clean leaves and debris out of swimming pool debris collecting containers without having to bend down and lift the container or its lid by hand.

Another object of this invention is to provide a leaf skimming apparatus, as aforesaid, having an elongate pole such that the apparatus may be positioned as desired without a user having to bend at the waist.

Still another object of this invention is to provide a leaf skimming apparatus, as aforesaid, which may be extended to collect debris directly from a water surface.

Yet another object of this invention is to provide a leaf skimming apparatus, as aforesaid, having a scoop assembly that selectively opens and closes in the manner of jaws.

A further object of this invention is to provide a leaf skimming apparatus, as aforesaid, that is lightweight and easy to use.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
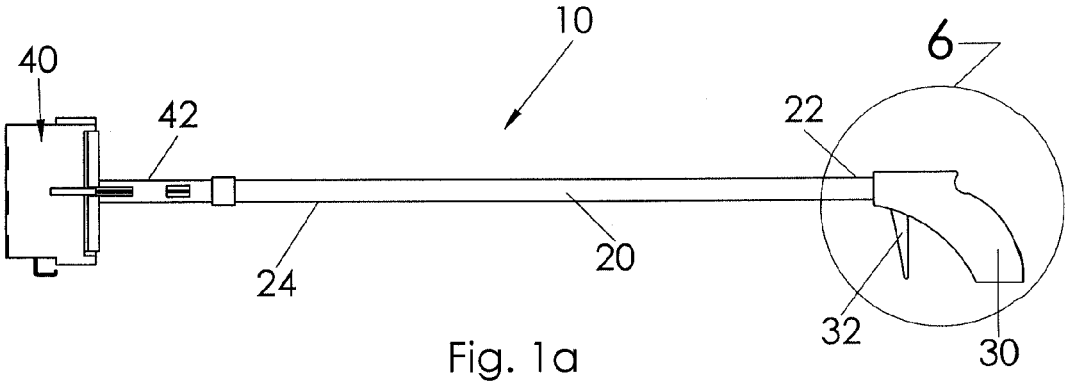
FIG. 1*a* is a top view of a leaf skimming apparatus according to a preferred embodiment of the present invention.
Figure 1B:
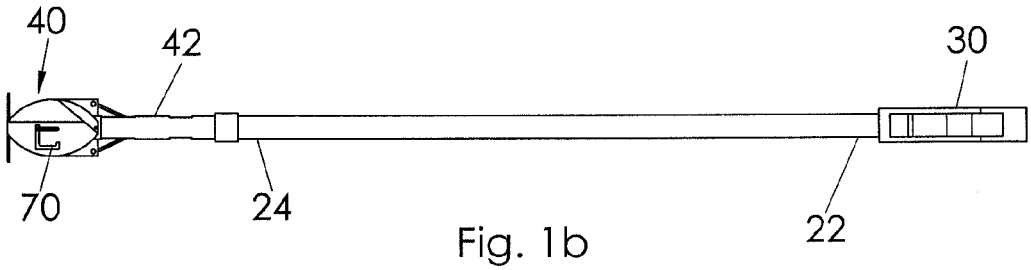
FIG. 1*b* is a side view of the leaf skimming apparatus as in FIG. 1*a;*
Figure 1C:
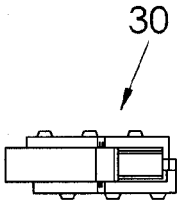
FIG. 1*c* is a distal end view of the leaf skimming apparatus as in FIG. 1*a;*

A leaf skimming apparatus according to a preferred embodiment of the present invention will now be described with reference to FIGS. 1 to 8*c* of the accompanying drawings. The leaf skimming apparatus 10 includes an elongate pole 20, a handle 30, a scoop assembly 40, a handle 30 with trigger 32, and a linkage 34 connecting the trigger 32 to the scoop assembly 40.

Figure 2:
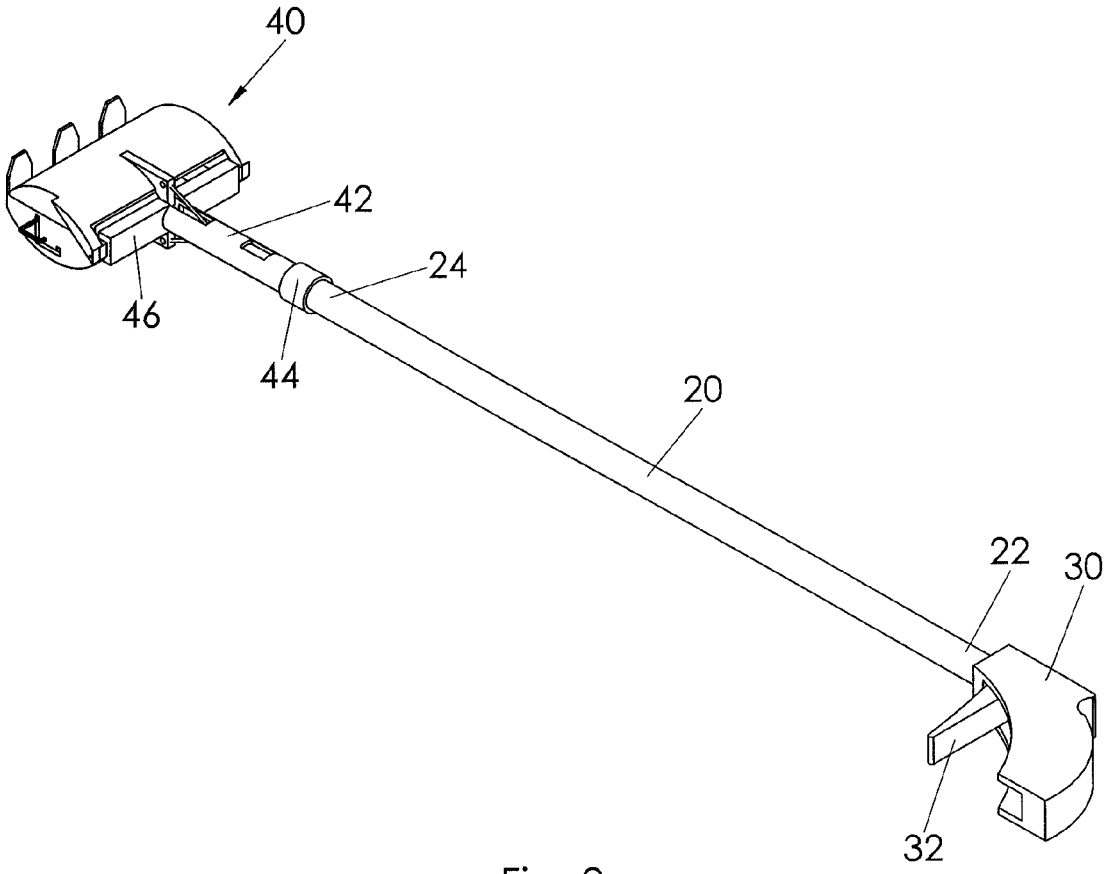
FIG. 2 is a perspective view of the leaf skimming apparatus as in FIG. 1*a* shown with a scoop assembly in a closed configuration.
Figure 4A:
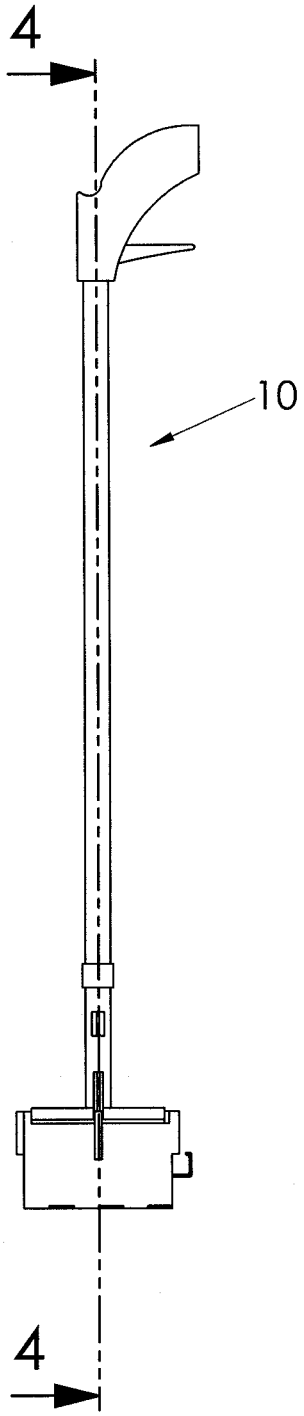
FIG. 4*a* is a top view of the leaf skimming apparatus as in FIG. 1*a;*
Figure 4B:
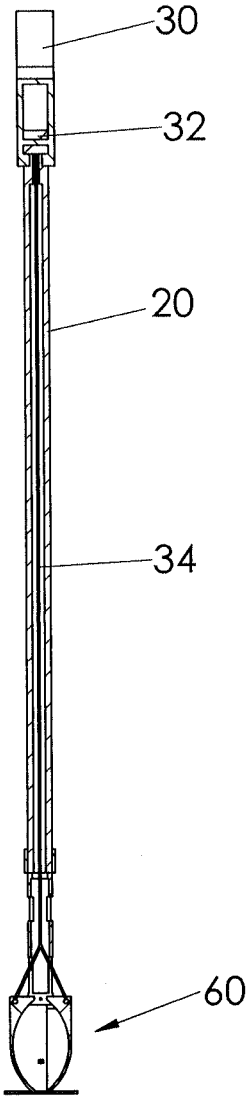
FIG. 4*b* is a sectional view taken along line 4*b*-4*b* of FIG. 4*a;*
Figure 5:
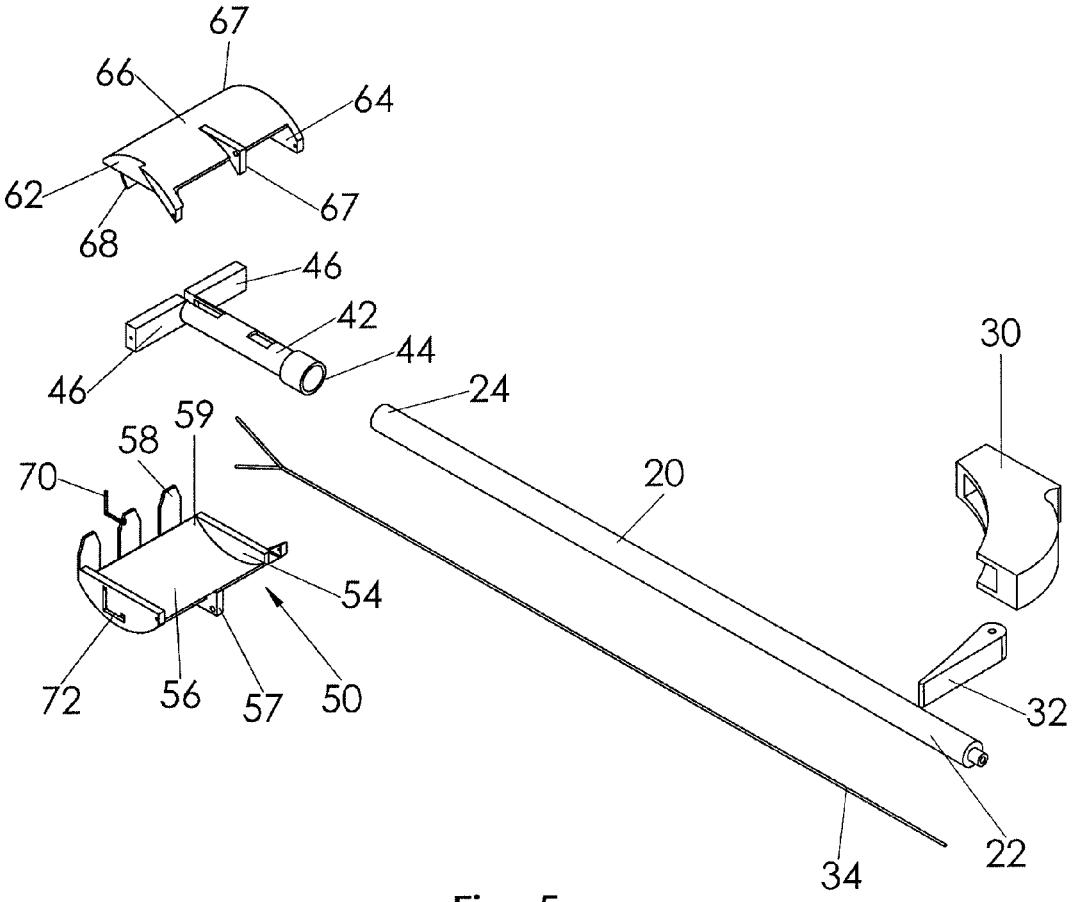
FIG. 5 is an exploded view of the leaf skimming apparatus as in FIG. 2.
Figure 6:
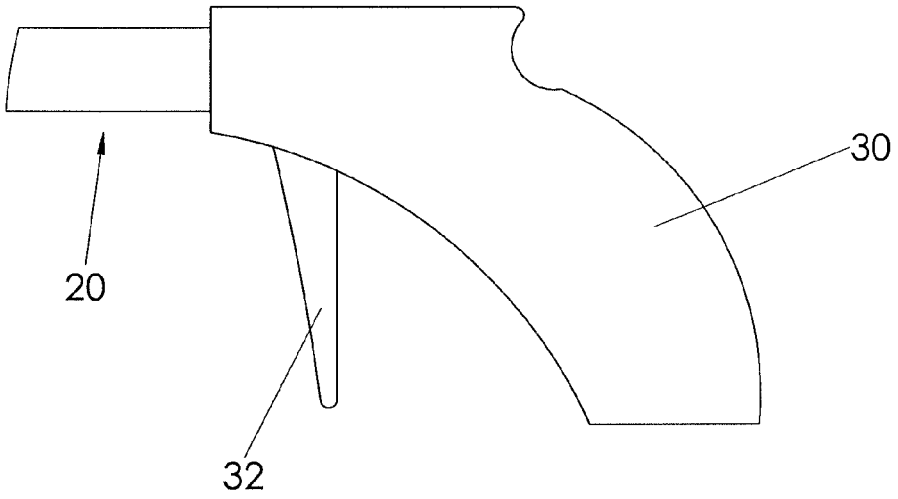
FIG. 6 is an isolated view on an enlarged scale of the handle shown in FIG. 1*a;*
Figure 7A:
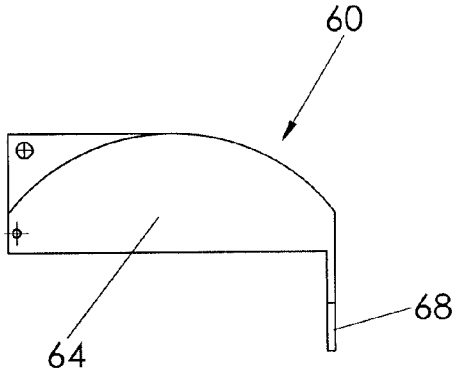
FIG. 7*a* is a side view of an upper scoop portion of the leaf skimming apparatus.
Figure 7B:
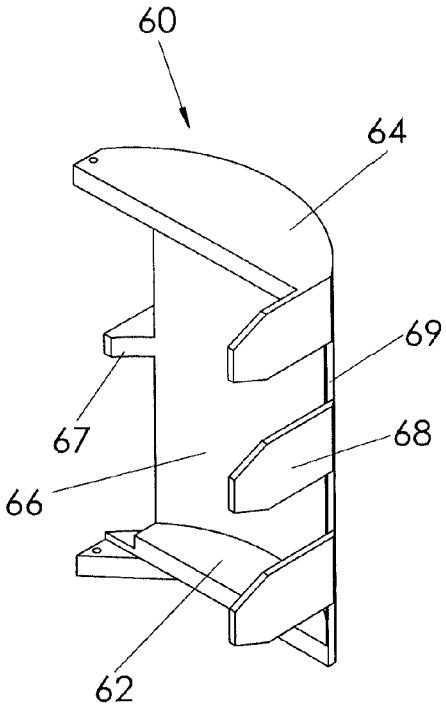
FIG. 7*b* is a perspective view of the upper scoop portion as in FIG. 7*a;*
Figure 7C:
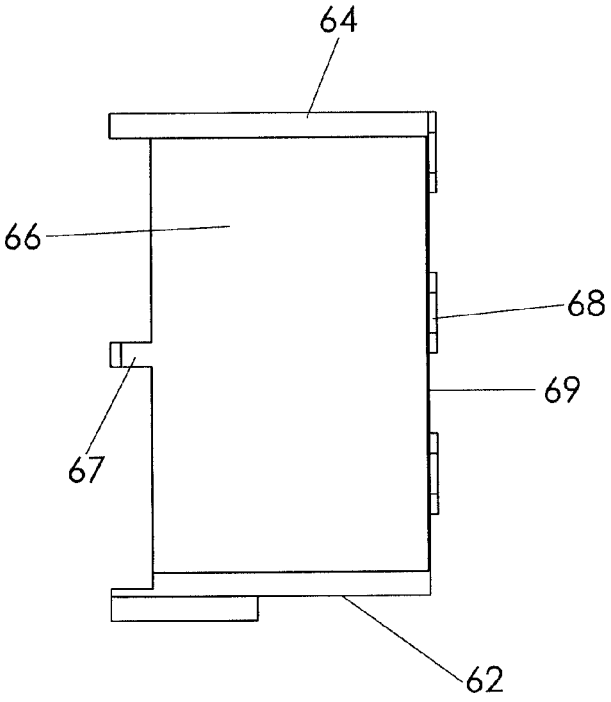
FIG. 7*c* is a bottom view of the upper scoop portion as in FIG. 7*a;*
Figure 8A:
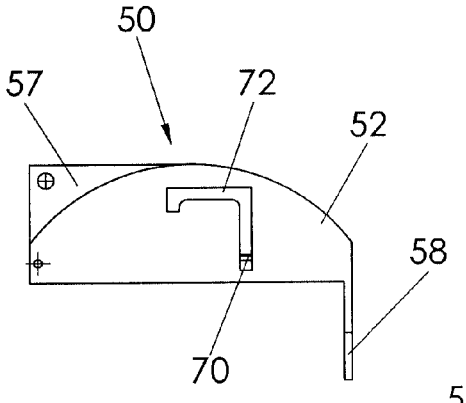
FIG. 8*a* is a side view of a lower scoop portion of the leaf skimming apparatus with the hook member in a retracted configuration.
Figure 8B:
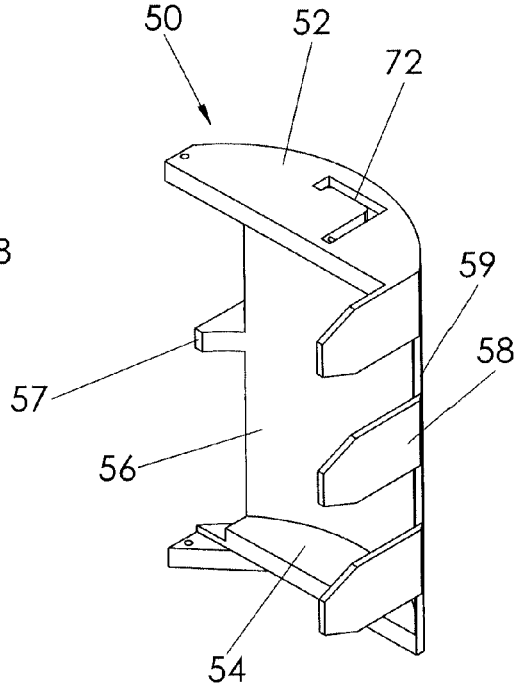
FIG. 8*b* is a perspective view of the lower scoop portion as in FIG. 8*a;*
Figure 8C:
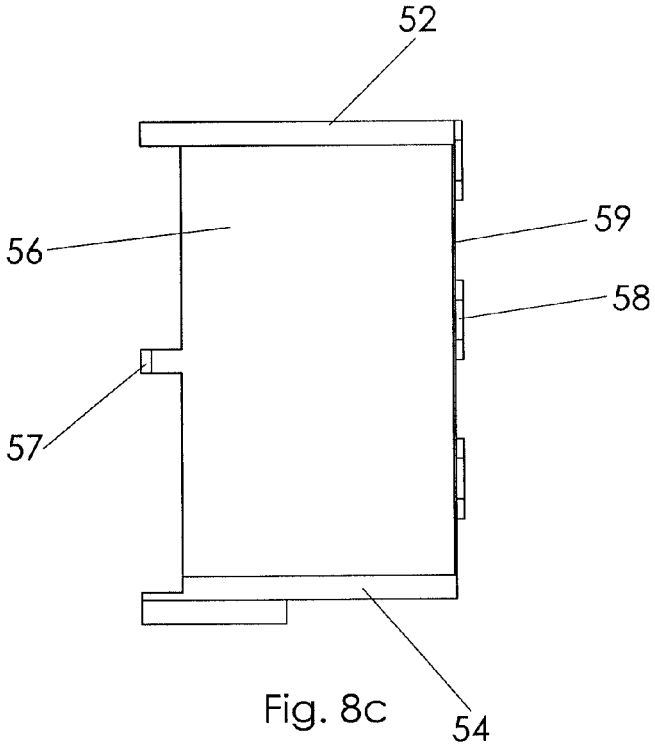
FIG. 8*c* is a bottom view of the lower scoop portion as in FIG. 8*a;*

The elongate pole 20 includes first 22 and second 24 ends and has a tubular configuration defining a hollow interior area (FIGS. 2 and 4). The handle 30 is coupled to the first end 22 of the pole 20 (also referred to as a proximal end) and includes an ergonomic configuration to be grasped by a user's hand. The handle 30 includes a trigger 32 that is manually operable by a user's hand or finger. The trigger 32 may be biased by a spring (not shown) such that the scoop portions are normally closed unless the spring biased trigger is actuated as will be described later. Alternatively, the trigger 32 may be configured such that the scoop portions are normally open unless the spring biased trigger is actuated.

The scoop assembly 40 is operatively coupled to the second end 24 of the pole 20 (also referred to as a distal end). It is understood that a mounting interface 42 may be utilized to couple the scoop assembly 40 to the pole second end 24. More particularly, the mounting interface 42 may include a tubular end 44 having a configuration that is complementary to the tubular second end 24 of the pole 20 and having opposed arms 46 to which the scoop assembly 40 may be pivotally coupled for movement between open and closed configurations as will be described in more detail below.

The scoop assembly 40 includes a lower scoop portion 50 and an upper scoop portion 60 that are cooperatively movable between an open configuration (FIG. 3) and a closed configuration (FIG. 2). More particularly, the upper scoop portion 60 includes opposed first 62 and second 64 side walls with a top wall 66 extending therebetween. The top wall 66 has an outwardly/upwardly concave configuration when viewed from its inner or interior area. In other words, the top wall 66 has an upwardly partially dome-shaped or hemispherical configuration that is configured to capture material on its inner surface. Similarly, the lower scoop portion 50 includes opposed first 52 and second 54 side walls with a bottom wall 56 extending therebetween. The bottom wall 56 has an outwardly/downwardly concave configuration when considered from its inner or interior area. In other words, the bottom wall 56 has an outwardly partially dome-shaped or hemispherical configuration that is configured to capture material on its inner surface. Together, the scoop portions define an interior area for collecting and temporarily storing debris as will be explained further below.

Figure 3:
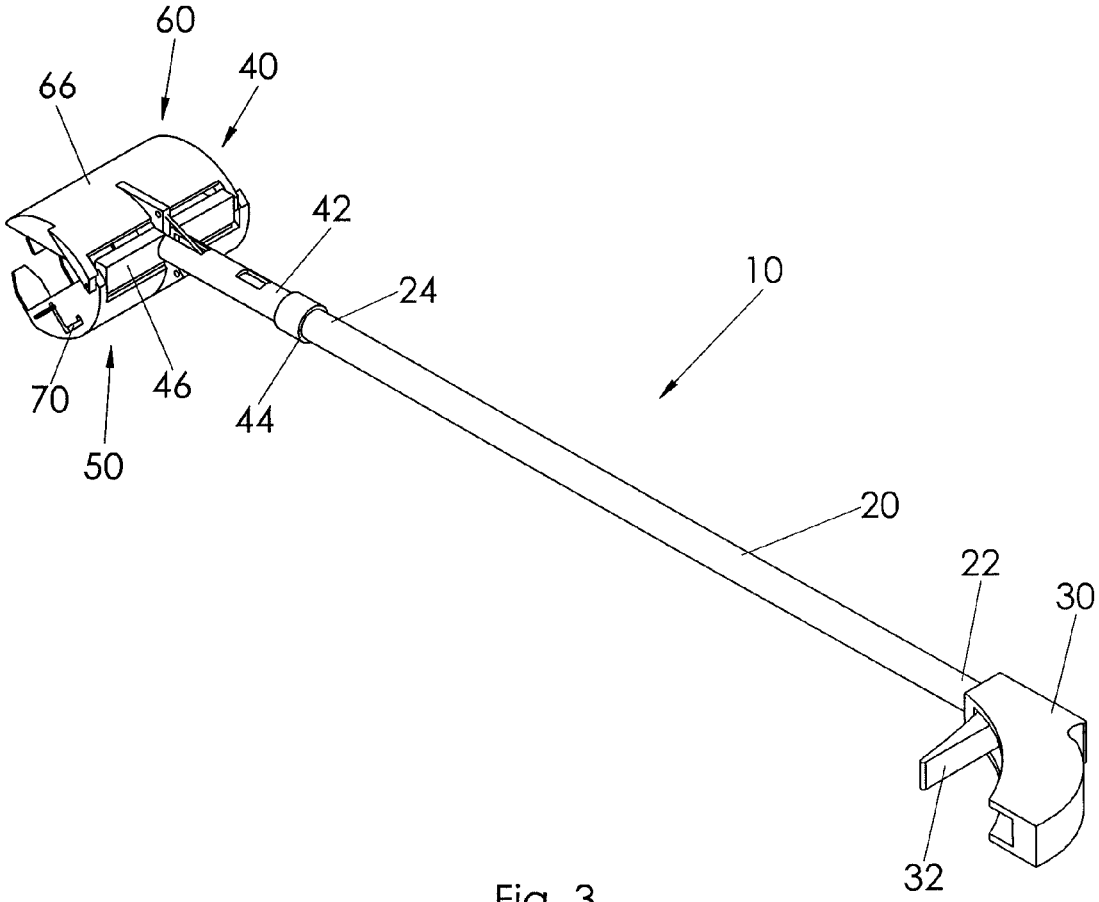
FIG. 3 is a perspective view of the leaf skimming apparatus as in FIG. 2 shown with the scoop assembly in an open configuration.

A linkage 34 is positioned in the interior area of the tubular pole 20 and interconnects the trigger 32 and the scoop assembly 40 (FIG. 4). The linkage 34 may be a wire having one end coupled to the trigger 32 and an opposed end coupled to the scoop assembly 40. More particularly, the opposed end of the linkage 34 may be bifurcated into two wire segments that are coupled to flanges 67, 57 positioned on the top 66 and bottom 56 walls of the upper 60 and lower 50 scoop portions, respectively. In operation, an actuation of the trigger 32 causes the linkage 34 to simultaneously retract or pull against the upper 60 and lower 50 scoop portions, thus causing the scoop assembly 40 to move toward the open configuration (FIG. 3). Movement of the trigger 32 in an opposite direction, such as by a spring returns the scoop assembly 40 to a closed configuration (FIG. 2).

Each scoop portion 50, 60 includes a plurality of finger portions 58, 68 coupled to and extending away from respective front edges 59, 69. Specifically, the finger portions 68 of the upper scoop portion 60 extend generally downwardly and the finger portions 58 of the lower scoop portion 50 extend generally upwardly. Free ends of the finger portions may be generally pointed although preferably not sharp as to be dangerous.

Figure 9A:
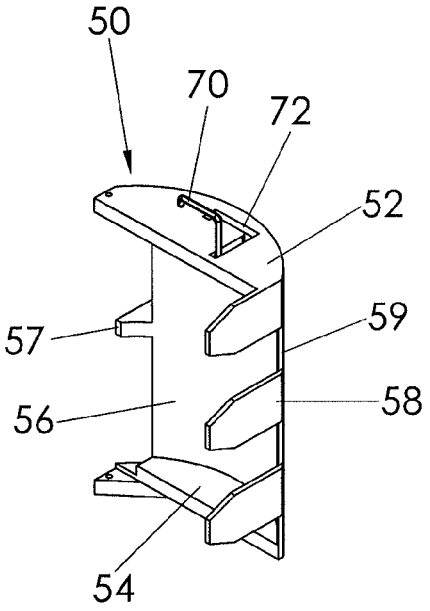
FIG. 9*a* is a perspective view of the lower scoop portion as in FIG. 8*b* with the hook member in an extended configuration.
Figure 9B:
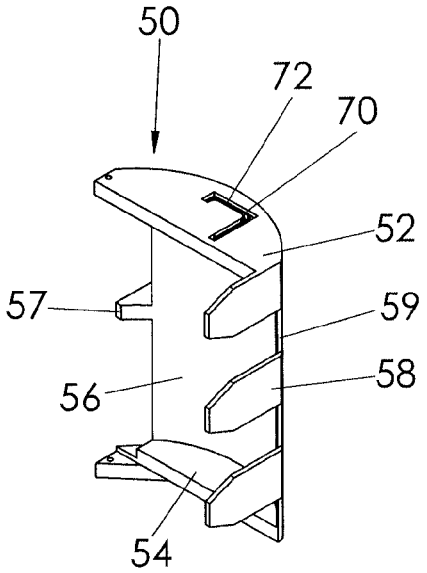
FIG. 9*b* is a perspective view of the lower scoop portion as in FIG. 8*b* with the hook member in a retracted configuration.
Figure 9C:
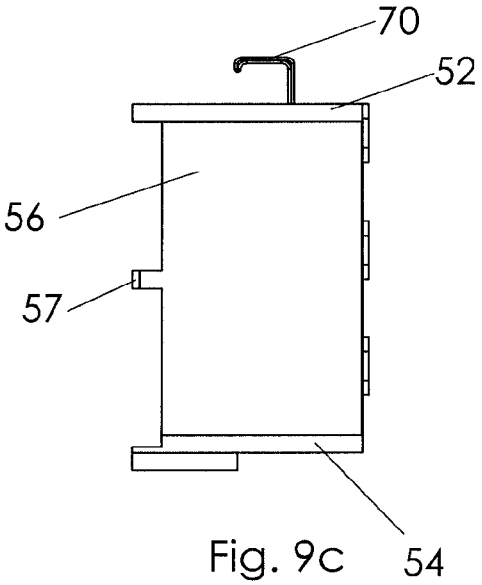
FIG. 9*c* is a top view of the lower scoop portion as in FIG. 9*a*.
Figure 9D:
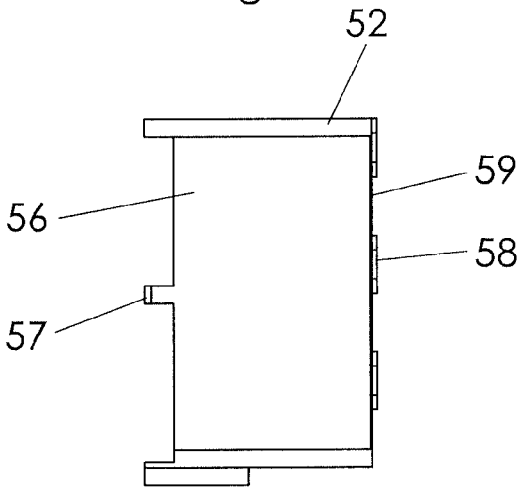
FIG. 9*d* is a top view of the lower scoop portion as in FIG. 9*c.*

Further, a hook member 70 may be pivotally coupled to a first side wall 52 of the lower scoop portion 50. The hook member 70 may be selectively movable between a retracted configuration generally adjacent the lower scoop portion first side wall 52 (FIGS. 8*b* and 9*b*) and an extended configuration extending outwardly away from the first side wall 52 (FIGS. 9*a* and 9*c*). The first side wall 52 may define a slot 72 into which the hook member 70 may be retracted at the retracted configuration. As shown in the drawings, the hook member 70 may include a generally L-shaped configuration that may be inserted into the slot or opening of a skimmer basket associated with a swimming pool so as to elevate and remove the container or its lid prior to operating the scoop assembly 40 to collect debris.

In use, the leaf skimming apparatus 10 may be used effectively to collect leaves, trash, and other debris from skimmer baskets, or other locations around or related to a swimming pool. First, a user may manually move the hook member 70 to the extended configuration. Using the extended hook member 70, the lid or entire skimmer basket may be lifted out of its operating position such that leaves or debris therein is exposed. Then, a user may operate the trigger 32 and, as a result, move the upper and lower scoop portions to the open configuration. The concave configurations of the scoop portions provide an interior area for collecting debris. The open scoop portions may then be positioned to surround debris within the skimmer basket. An opposite movement of the trigger 32 then causes the scoop assembly 40 to return to a closed configuration and to effectively capture debris therein. The debris may then be deposited into a trash receptacle or the like by the user's operation of the trigger 32 to open the scoop assembly.

Accordingly, the leaf skimming apparatus is effective to collect leaves or other debris from skimmer baskets associated with a swimming pool without the user having to bend at the waist.

The invention claimed is:

1. A leaf skimming apparatus, comprising:

an elongate pole having opposed first and second ends and having a generally tubular configuration that defines an interior area;

a handle positioned adjacent said pole first end;

a scoop assembly coupled to said pole second end, said scoop assembly having lower and upper scoop portions pivotally movable between open and closed configurations;

a manually operable trigger coupled to said handle, said trigger being operably connected to said scoop assembly and configured to selectively move said lower and upper scoop portions between said open and closed configurations when actuated; and a linkage situated in said pole interior area that is connected at one end to said trigger and at another end to said scoop assembly, said linkage configured to move said lower and upper scoop portions between said open and closed configurations when actuated by said trigger;

wherein said scoop assembly includes a hook member pivotally coupled to said first side wall of said lower scoop portion, said hook member being movable between a retracted configuration adjacent said lower scoop portion first side wall and an extended configuration extending outwardly from said lower scoop portion first side wall.

2. The leaf skimming apparatus as in claim 1, wherein:

said lower scoop portion includes first and second lower scoop side walls and a bottom wall extending between said first and second lower scoop side walls, said bottom wall having a downwardly concave configuration; and said upper scoop portion includes first and second upper scoop side walls and a top wall extending between said first and second side walls, said top wall having an upwardly concave configuration.

3. The leaf skimming apparatus as in claim 2, wherein:

said upper scoop portion top wall includes a front edge and a plurality of upper scoop portion fingers coupled to and extending away from said upper scoop portion top wall front edge; and said lower scoop portion bottom wall includes a front edge and a plurality of lower scoop portion fingers coupled to and extending away from said lower scoop portion bottom wall front edge.

4. The leaf skimming apparatus as in claim 3, wherein:

said each one of said plurality of upper scoop portion fingers has a generally pointed shape; and said each one of said plurality of lower scoop portion fingers has a generally pointed shape.

5. The leaf skimming apparatus as in claim 3, wherein said scoop assembly includes a hook member pivotally coupled to said first side wall of said lower scoop portion, said hook member being movable between a retracted configuration adjacent said lower scoop portion first side wall and an extended configuration extending outwardly from said lower scoop portion first side wall.

6. The leaf skimming apparatus as in claim 1, wherein said upper scoop portion first side wall defines a recess having a configuration complementary to a configuration of said hook member so as to receive said hook member therein at said retracted configuration.

7. The leaf skimming apparatus as in claim 1, wherein said upper scoop portion first side wall defines a recess having a configuration complementary to a configuration of said hook member so as to receive said hook member therein at said retracted configuration.

8. The leaf skimming apparatus as in claim 1, wherein said linkage includes a wire having a first end coupled to said trigger and a second end being bifurcated into two segments, said bifurcated segments being coupled to said lower and said upper scoop portions, respectively, such that said lower and said upper scoop portions are moved between said open and said closed configurations upon actuation of said linkage.

9. A leaf skimming apparatus, comprising:

an elongate pole having opposed first and second ends and having a generally tubular configuration that defines an interior area;

a handle coupled to said pole first end;

a scoop assembly coupled to said pole second end, said scoop assembly having lower and upper scoop portions pivotally movable between open and closed configurations;

a manually operable trigger coupled to said handle, said trigger being operably connected to said scoop assembly and configured to selectively move said lower and upper scoop portions between said open and closed configurations;

a linkage situated in said pole interior area that is connected at one end to said trigger and at another end to said scoop assembly, said linkage configured to move said lower and upper scoop portions between said open and closed configurations when actuated by said trigger;

wherein:

said lower scoop portion includes first and second lower scoop side walls and a bottom wall extending between said first and second lower scoop side walls, said bottom wall having a downwardly concave configuration;

said upper scoop portion includes first and second upper scoop side walls and a top wall extending between said first and second side walls, said top wall having an upwardly concave configuration; and said scoop assembly includes a hook member pivotally coupled to said first side wall of said lower scoop portion, said hook member being movable between a retracted configuration adjacent said lower scoop portion first side wall and an extended configuration extending outwardly from said lower scoop portion first side wall.

10. The leaf skimming apparatus as in claim 9, wherein:

said upper scoop portion top wall includes a front edge and a plurality of upper scoop portion fingers coupled to and extending away from said upper scoop portion top wall front edge; and said lower scoop portion bottom wall includes a front edge and a plurality of lower scoop portion fingers coupled to and extending away from said lower scoop portion bottom wall front edge.

11. The leaf skimming apparatus as in claim 10, wherein:

said each one of said plurality of upper scoop portion fingers has a generally pointed shape; and said each one of said plurality of lower scoop portion fingers has a generally pointed shape.

12. The leaf skimming apparatus as in claim 11, wherein said upper scoop portion first side wall defines a recess having a configuration complementary to a configuration of said hook member so as to receive said hook member therein at said retracted configuration.

13. The leaf skimming apparatus as in claim 9, wherein said upper scoop portion first side wall defines a recess having a configuration complementary to a configuration of said hook member so as to receive said hook member therein at said retracted configuration.

14. The leaf skimming apparatus as in claim 9, wherein said linkage includes a wire having a first end coupled to said trigger and a second end being bifurcated into two segments, said bifurcated segments being coupled to said lower and said upper scoop portions, respectively, such that said lower and said upper scoop portions are moved between said open and said closed configurations upon actuation of said linkage.

* * * * *